US007987531B2

(12) United States Patent
West

(10) Patent No.: US 7,987,531 B2
(45) Date of Patent: Aug. 2, 2011

(54) PORTABLE FLOATING HOT TUB

(76) Inventor: Paul E. West, Huntington Beach, CA (US)

( * ) Notice: Subject to any disclaimer, the term of this patent is extended or adjusted under 35 U.S.C. 154(b) by 828 days.

(21) Appl. No.: 12/072,438

(22) Filed: Feb. 26, 2008

(65) Prior Publication Data

US 2008/0201838 A1 Aug. 28, 2008

Related U.S. Application Data

(60) Provisional application No. 60/903,567, filed on Feb. 27, 2007.

(51) Int. Cl.
*A47K 3/06* (2006.01)

(52) U.S. Cl. ..... 4/541.3; 4/585; 441/131

(58) Field of Classification Search ..... 4/489, 585, 4/541.3, 541.4, 541.1; 441/129, 130, 131
See application file for complete search history.

(56) References Cited

U.S. PATENT DOCUMENTS 1,925,175 A * 9/1933 Day ..... 4/487
3,191,190 A * 6/1965 Lowry ..... 4/585
3,324,488 A * 6/1967 Schulz, Jr. ..... 114/346
3,571,819 A * 3/1971 Puncochar ..... 4/487
4,126,905 A * 11/1978 Russell et al. ..... 4/492
4,149,281 A * 4/1979 Bob et al. ..... 4/487
4,706,307 A * 11/1987 Smith ..... 4/487
4,754,502 A * 7/1988 Bowen ..... 4/487
5,570,480 A * 11/1996 Yeung ..... 4/487
6,795,983 B2 * 9/2004 Brown et al. ..... 4/487
7,032,258 B2 * 4/2006 O'Hanlon ..... 4/487
7,314,399 B2 * 1/2008 Turner ..... 441/129

* cited by examiner

*Primary Examiner* — David Purol

(57) ABSTRACT

A portable floating hot tub that is easy to assemble and take down and can be used in environments with extremely cold and turbulent water. The hot tub has three main components: a collapsible frame made of connected rigid members, an insulated liner sized and shaped to closely fit against the deployed frame and form a subassembly, and an inflatable pontoon that may have a central aperture for receiving the subassembly. The pontoon is first inflated and placed on the body of water, after which the frame and liner subassembly are placed over the central aperture. Filling the internal volume defined by the insulated liner with water causes the subassembly to descend within the pontoon. Cooperating means on the subassembly and/or pontoon prevent the subassembly from passing completely through the central aperture. A source of heated water such as a portable heater having a heating capacity of at least 30,000 BTUs rapidly heats up the water within the hot tub. The system components can be transported in one or more carry bags of less than 100 pounds and deployed and taken down by one person in an extremely small space, such as on a boat.

20 Claims, 5 Drawing Sheets

50'
64
66
64
50'
32
74
50'
70
70
76
68

32
50

74
84
81
86
82

8
8
86
80
30
40

50
50
32
78
86
34

PORTABLE FLOATING HOT TUB

RELATED APPLICATIONS

This application claims priority under 35 U.S.C. §119 to U.S. Provisional Application No. 60/903,567, filed Feb. 27, 2007.

FIELD OF THE INVENTION

The present invention relates to a portable hot tub that floats in a body of water and, in particular, to an easily and rapidly deployable, portable floating hot tub that can be used in bodies of water that are turbulent and cold.

BACKGROUND OF THE INVENTION

Hot tubs or spas are excellent ways for relaxing and rejuvenating, as well as therapeutically soothing sore muscles and body parts. The conventional hot tub is mounted in or above the ground, has rigid sidewalls, typically a molded fiberglass shell for containing water, and a relatively sophisticated and expensive electronically monitored and controlled water heating system relatively permanently connected an existing water supply system. Hot tubs are often combined with standard swimming pools, either close to but spaced from the pool or immediately adjacent thereto separated by a low dividing wall. The ability to switch back and forth from the cold pool water to the hot spa water is extremely exhilarating.

To date, there has not been an economically feasible portable hot tub for use in remote locations away from the backyard. One difficult hurdle in constructing a portable hot tub is the necessity of providing extremely strong sidewalls to contain the large amount of water therein. Of course providing sturdy sidewalls increases the size and weight of the device which hinders portability. One possible answer to this practical problem is to immerse the hot tub in a larger body of water, which equilibrates the hydraulic forces across the spa wall and therefore reduces the structural strength requirements.

Several designs for floating hot tubs, spas and pools are known, including U.S. Pat. Nos. 4,126,905, 4,135,256, 4,754,502, 5,470,480, 6,795,983, and 7,032,258. For a number of reasons, these designs lack one or more of the following: easy portability, easy and rapid setup, stability in turbulent water, or economic practicality. Some relatively recent floating hot tubs, such as in U.S. Pat. No. 6,795,983, commercially available as the HOT POD floating spa, are primarily designed for use in a pool with relatively flexible and lightweight construction, which makes them ill-suited for use in very cold and turbulent water. Indeed, the '983 patent promotes the ability to easily depress the hot tub upper rim to facilitate entry and exit of both people and surrounding ambient water. Hot tubs have been built into larger boats, including crew ships and luxury yachts. Though technically "floating," these hot tubs are not portable by themselves, and are relatively permanently structurally installed and connected to the electrical and water systems of the boat.

Consequently, there remains a need for a floating hot tub that is portable, easy and quick to set up by one person, stable in rough waters, and within the budget of ordinary consumers.

SUMMARY OF THE INVENTION

The present invention relates to a hot tub that is portable and may be placed in a body of water such as a pool, a lake, river or the ocean. A primary application is to use the hot tub behind a boat. Boaters in particular would appreciate the ability to quickly deploy a hot tub in the water behind their boat wherever they are moored. The hot tub can also be used next to a dock or floating independently in a body of water.

In general, the present invention provides a hot tub that is portable, easily assembled, easy to enter and exit, provides for comfortable seating, and can be used in environments where there is cold and turbulent water. The hot tub has a collapsible, rigid frame that makes it operable in turbulent water such as in a river or on the ocean. Walls of the hot tub are constructed from a thermally insulating material so that it retains heat and can be operated in cold water environments found in lakes, rivers and oceans. The hot tub is portable and can be carried and assembled easily by a single individual in confined environments such as on a boat or on the dock. Finally, the rigid flame structure of the tub provides for comfortable seating.

In one embodiment, the hot tub is constructed from three independent components: a pontoon, a frame and walls. The hot tub is supported in the water by a floating inflatable pontoon. The pontoon can be constructed from one or more bladder units. The pontoon must be large enough to stabilize the tub when people enter or leave the tub. The support frame of the tub is made with structural materials such as pipes or rods, or any other structural material that may be easily disassembled. The frame may include provisions for seating of one or more people in the hot tub. Extra material may be placed between the frame arms and the pontoon to distribute the weight of the frame on the pontoon. The walls of the hot tub are made from a thermally insulating material such as neoprene rubber. The insulating material helps to keep the water in the tub from losing heat too rapidly to the external body of water. When the hot that is filled with water, the majority of the tub is submerged below the surface of the external body of water, providing stability. The hot tub is designed such that when filled with water, the water level inside the tub is approximately the same level as the external body of water.

In accordance with one aspect of the invention, a portable floating hot tub comprises a collapsible frame of connected rigid members having a collapsed configuration and a deployed configuration. The deployed frame forms an interior volume, at least one seat for a person within the volume, and an upper periphery. An insulated liner is sized and shaped to fit closely against and attach to the deployed frame to form a subassembly and define a hot tub fill volume within the liner. An inflatable pontoon buoyantly supports the deployed frame and liner subassembly. Cooperating means on the collapsible frame, the insulated liner, and/or the inflatable pontoon couples the frame and liner subassembly to the pontoon. The inflated pontoon has sufficient buoyancy to support the frame and liner subassembly in a body of water with the upper periphery of the frame above the water level. Finally, a source of hot water connects to circulate water to and from the hot tub fill volume.

In one embodiment, the cooperating means comprises at least one lateral extension from the frame and liner subassembly that engages the pontoon. For instance, the cooperating means may be flexible straps. The source of hot water desirably comprises a hand-carried portable heater having an inlet and an outlet and hoses connected therewith for circulating water to and from the hot tub fill volume. A preferred insulated liner comprises a foam core and protective outer layers, and is easily separable from the frame. In one form the collapsible frame comprises a plurality of lightweight rigid struts connected at junctions. For autonomous navigation of the hot tub a small motor may be mounted on the pontoon. Advantageously, the inflatable pontoon has a closed geometric form surrounding a central aperture within which the deployed frame and liner subassembly are peripherally supported.

Another portable floating hot tub of the invention comprises a collapsible frame of connected rigid members having a collapsed configuration and a deployed configuration, wherein the deployed frame forms an interior volume, at least one seat for a person within the volume, and an upper periphery. An insulated liner is sized and shaped to fit closely against and attach to the deployed frame to form a subassembly and define a hot tub fill volume within the liner. A pontoon buoyantly supports the deployed frame and liner subassembly such that the upper periphery of the frame is above the water level. A hand-carried portable heater having an inlet and an outlet and hoses connected therewith circulates water to and from the hot tub fill volume. The heater has a tilt sensor that shuts off operation of the heater if the heater tilts more than a predetermined amount from an upright orientation. Cooperating means may be provided on the collapsible frame, the insulated liner, and/or the pontoon for buoyantly coupling the frame and liner subassembly to the pontoon. The collapsible frame desirably comprises a plurality of rigid struts hinged together. The heater may have a gas burner and an electric control therefore, and a heating capacity of at least 30,000 BTUs. Another element of the system may be a submergible water pump having an inlet and an outlet with an outlet hose connected to the inlet of the heater. The pontoon desirably has at least one inflatable bladder that is capable of being collapsed and hand-carried in a bag.

A still further embodiment of a portable floating hot tub comprises a collapsible frame, an insulated liner attached to the deployed frame to form a subassembly, and an inflatable pontoon arranged to buoyantly support the deployed frame and liner subassembly. A hand-carried portable heater is provided to circulate water to and from the hot tub fill volume, and the hot tub components can be collapsed and stored in one or more carry bags with a combined weight of less than 100 pounds. Preferably, the collapsible frame comprises a plurality of lightweight rigid struts connected at junctions, some of which are dedicated hinges and some of which are detachable. The inflatable pontoon may have a closed geometric form surrounding a central aperture within which the deployed frame and liner subassembly are peripherally supported. Desirably the insulated liner is easily separable from the frame, and more particularly the insulated liner has a plurality of tabs secured thereto for attaching the liner to the deployed frame.

A method for rapidly deploying a floating hot tub of the present invention includes deploying a collapsible frame of connected rigid members having a collapsed configuration and a deployed configuration, wherein the deployed frame forms an interior volume, at least one seat for a person within the volume, and an upper periphery. An insulated liner sized and shaped to fit closely against and attach to the deployed frame is provided, and the deployed frame and the liner are coupled to form a subassembly and define a hot tub fill volume within the liner. An inflatable pontoon arranged to buoyantly support the deployed frame and liner subassembly is inflated placed it in a body of water. The user fills the hot tub fill volume with water so that the upper periphery of the frame is buoyantly supported by the pontoon above the water level, and then circulates heated water to the hot tub fill volume.

The pontoon preferably defines a central aperture and the step of filling causes the frame and liner subassembly to descend through the aperture. Furthermore, cooperating means may be provided on the collapsible frame, the insulated liner, and/or the inflatable pontoon that prevent the subassembly from passing completely through the central aperture. For instance, the cooperating means may be at least one lateral extension from the frame and liner subassembly that engages the pontoon. Desirably, the source of heated water comprises a hand-carried portable heater having an inlet and an outlet and hoses connected therewith for circulating water to and from the hot tub fill volume. The collapsible frame may be a plurality of lightweight rigid struts connected at junctions, and the step of deploying the frame comprises unfolding the rigid struts and securing at least one junction to maintain the deployed configuration. Further, the step of coupling the deployed frame and the liner preferably involves inverting the frame, draping the insulated liner over the frame, righting the frame and liner, and coupling an upper edge of the liner to the upper periphery of the frame. The insulated liner may have a plurality of tabs secured thereto for attaching the liner to the deployed frame.

Another method for deploying a floating hot tub embodied herein, comprises deploying a collapsible frame and coupling an insulated liner thereto to form a subassembly. A user places a pontoon in a body of water, positions the frame and liner subassembly adjacent the pontoon, and fills the hot tub fill volume with water so that the frame and liner subassembly descend until the upper periphery of the frame is buoyantly supported by the pontoon above the water level. Heated water is circulated to the hot tub fill volume, and the floating hot tub is detached from any mooring in the body of water and a means of propulsion is used to return to the original or another mooring. Desirably, the means for propulsion comprises a small motor mounted on the pontoon. In one embodiment, the pontoon comprises at least one inflatable bladder, and the method includes inflating the bladder. The pontoon may have a closed geometric form surrounding a central aperture within which the frame and liner subassembly is peripherally supported. In the latter instance, the step of filling causes the frame and liner subassembly to descend through the aperture, and cooperating means are provided on the collapsible frame, the insulated liner, and/or the pontoon that prevent the subassembly from passing completely through the central aperture.

A still further method for rapidly deploying a floating hot tub, comprises:

a. deploying a collapsible frame of connected rigid members, wherein the deployed frame forms an interior volume, at least one seat for a person within the volume, and an upper periphery;
b. coupling an insulated liner to the deployed frame to form a subassembly and define a hot tub fill volume within the liner;
c. inflating a pontoon;
d. placing the inflated pontoon in a body of water of ambient temperature;
e. positioning the deployed frame and liner subassembly adjacent to the pontoon;
f. filling the hot tub fill volume with ambient temperature water so that frame and liner subassembly descends until the upper periphery of the frame is buoyantly supported by the pontoon aperture above the water level;
g. circulating heated water to the hot tub fill volume to heat the water to at least 100° F.; and
h. performing the preceding steps in about an hour.

The pontoon may define a central aperture, such that the step of filling causes the frame and liner subassembly to descend through the aperture, wherein cooperating means are provided on the collapsible frame, the insulated liner, and/or the inflatable pontoon that prevent the subassembly from passing completely through the central aperture. The source of heated water preferably comprises a hand-carried portable heater having an inlet and an outlet and hoses connected therewith for circulating water to and from the hot tub fill volume, the heater having a gas burner and an electric control therefore, and a heating capacity of at least 30,000 BTUs. The collapsible frame may be a plurality of lightweight rigid struts connected at junctions, and the step of deploying the frame comprises unfolding the rigid struts and securing at least one junction to maintain the deployed configuration. The step of coupling the deployed frame and the liner desirably comprises inverting the frame, draping the insulated liner over the frame, righting the frame and liner, and coupling an upper edge of the liner to the upper periphery of the frame. The insulated liner may have a plurality of tabs secured thereto for attaching the liner to the deployed frame. All of the aforementioned steps may be performed by a single person.

BRIEF DESCRIPTION OF THE DRAWINGS

Features and advantages of the present invention will become appreciated as the same become better understood with reference to the specification, claims, and appended drawings wherein:

DETAILED DESCRIPTION OF THE PREFERRED EMBODIMENTS

The present invention provides a portable floating hot tub that is an improvement over previous designs. The exemplary hot tub of the present invention is easy to set up and take down by one person in any confined space and in a short amount of time, is stable in even choppy waters, and retains heat for a significant length of time. Moreover, the components of the hot tub can be carried in two small luggage-sized bags that are easily transported and stored in a small space. A number of desirable features described herein combine to provide a truly advanced portable floating hot tub, though it should be understood that certain features by themselves and some combinations thereof are believed novel and may be incorporated into other portable floating hot tubs for a similar advantage. Therefore, the present invention should not be considered limited to the exemplary system described herein, but instead should be evaluated by reference to the appended claims.

The 1 illustrates an exemplary floating hot tub 20 of the present invention deployed in an external body of water W with a woman enjoying a soak in a volume V of hot water therein. The hot tub 20 is shown floating just off the back of a boat B with a portable heater 22 supported on a transom platform P thereof. The boat B represents any number of solid surfaces from which to deploy the hot tub 20, such as the edge of the swimming pool, a dock, shoreline, etc. Likewise, the body of water W represents any number of larger bodies of water, including the ocean, lakes, rivers and ponds, swimming pools, etc.

The present invention is particularly well adapted for deploying off the back of the boat because of its small portable size and minimal space requirements for set up. Although the floating hot tub 20 desirably remains tethered to the boat, its particularly effective insulating properties and stability permit it to float freely for some time before the inner volume V loses heat. A series of spaced handles 24 around the outside of the hot tub 20 enhance maneuverability and provide anchoring members through which to tether a line. In one particular configuration, the inner volume V is about 250 gallons and the heated water can remain hot for hours, even in the coldest environments.

Figure 1:
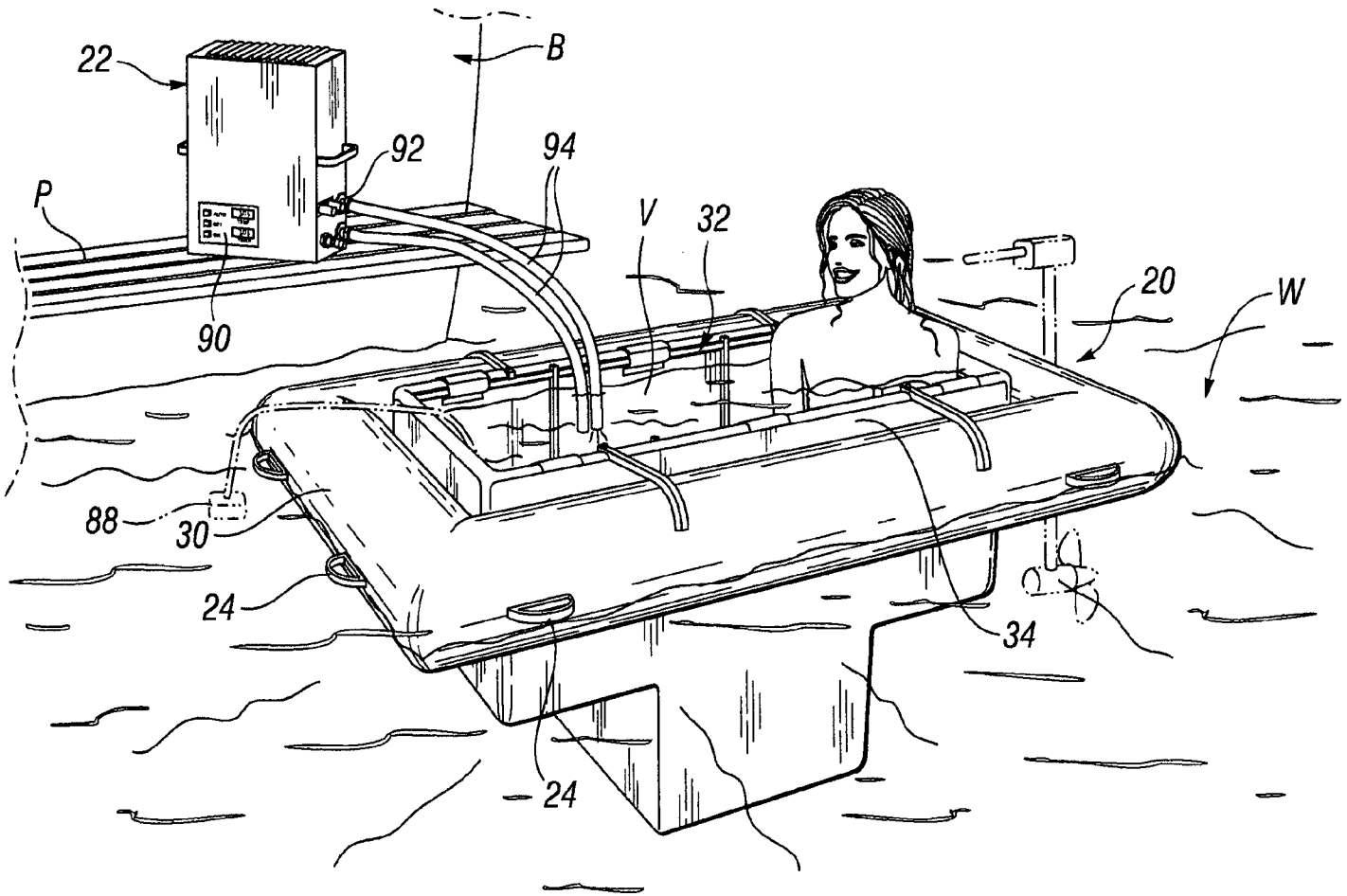
FIG. 1 is a perspective view of an exemplary potable floating hot tub of the present invention deployed off the back of a boat, and illustrating a portable heater having hoses connected thereto for circulating hot water to an inner volume of the hot tub.
Figure 2:
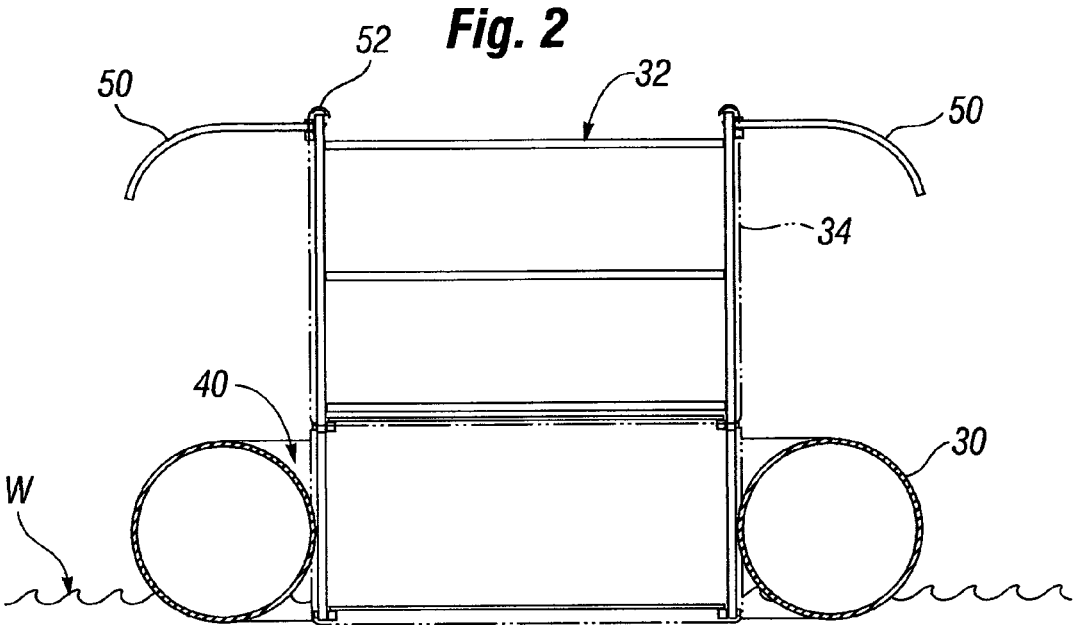
FIG. 2 schematically illustrates an exemplary rigid frame and insulated liner in a deployed configuration, prior to filling an inner volume with water, and positioned within a central aperture of a buoyant pontoon on a body of water.
Figure 3:
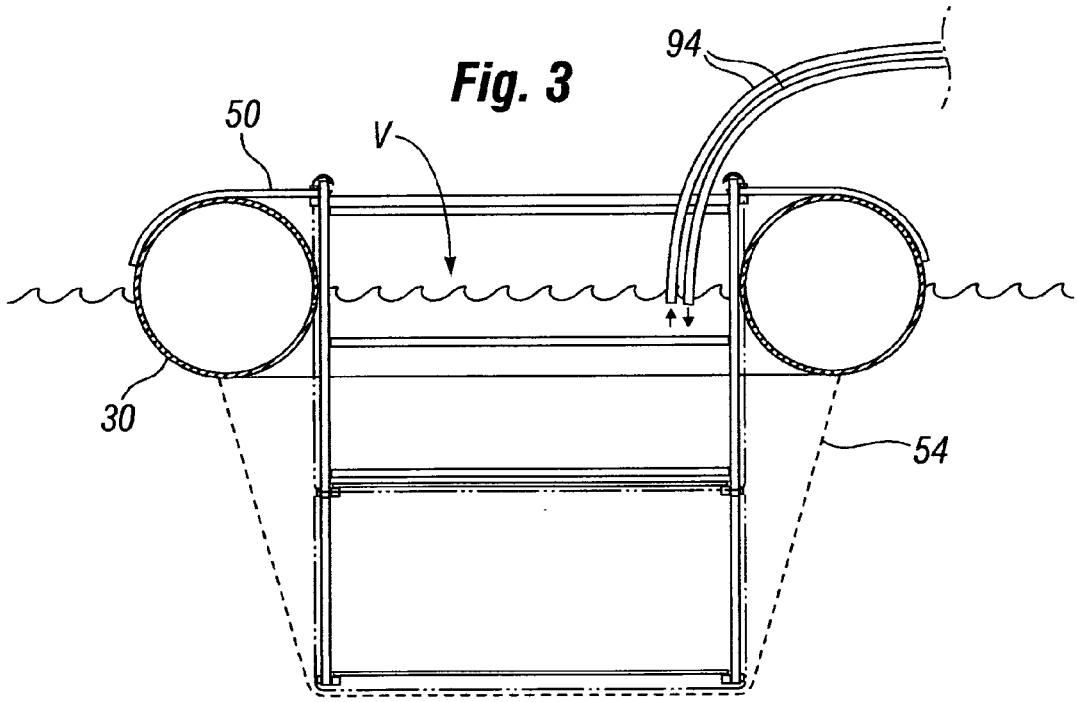
FIG. 3 schematically illustrates the rigid frame and insulated liner after having an inner volume filled with water such that the assembly descends within the central aperture of the pontoon.

With reference those to FIGS. 1-3, the hot tub 20 comprises three main components: a floating pontoon 30, a rigid frame 32, and an insulated liner 34 that forms walls dividing the inner volume V from the exterior body of water W. The three main components are separable for transport and assembled just prior to deployment in the water W. FIG. 2 illustrates the pontoon 30 floating on the water W and a subassembly of the frame 32 and liner 34 buoyantly supported by the pontoon. A procedure for assembling the hot tub 20 will be described below, in particular with reference to FIGS. 6 and 7.

As seen in FIG. 1, the pontoon 30 comprises a closed geometric form of continuous air-filled tubular bladders defining a central aperture 40. In the exemplary embodiment the closed geometric form is rectangular. The subassembly of the frame 32 and liner 34 is positioned within the central aperture 40 and peripherally supported by the pontoon 30. Of course, those of skill in the art will understand that the principles of the present invention described herein are not solely limited to a rectangular closed configuration, and other shapes as well as multiple independent or connected pontoons are contemplated. For instance, only two parallel sides of the illustrated pontoon 30 may be utilized, either connected together with rods or deployed independently and separately coupled to the subassembly of the frame 32 and liner 34. The illustrated hot tub 20 provides two comfortable seats for the enjoyment of two people at once, as will be explained. Of course, by doubling the width of the various components a four-person hot tub could be formed. Similarly, a round, hexagonal, or other shaped hot tub could be constructed based on the principles described herein.

The pontoon 30 may be constructed from one or more bladder units inflated with air. That is, the entire rectangular pontoon 30 may be constructed from a single bladder unit having a common interior inflation chamber. Alternatively, the pontoon 30 maybe constructed of a series of connected and separate bladder units having separately inflated chambers. The latter configuration will provide a measure of redundancy for safety in case one of the bladder units fails or is punctured. One useful configuration is to provide at least two inflation chambers separated by one-way valves, yet only a single exterior insulation. In such a system, the setup time remains about the same, though leakage from of one of the inflation chambers will not affect the entire pontoon. The bladder units should be large enough to keep outside water from entering the hot tub 20, and the pontoon should be large enough to stabilize the hot tub when people enter or leave directly from the surrounding body of water, from a dock, or from the swim platform P of the boat B. In one exemplary embodiment, the bladders are made of 0.9 mm PVC tarp material, and are approximately 1 foot in diameter.

As mentioned above, FIG. 2 illustrates the subassembly of the rigid frame 32 and insulated liner 34 in the central aperture 40 of the pontoon 30. In this configuration, the insulated liner 34 closely surrounds the deployed frame 32 and defines a hot tub fill volume therewithin. That is, the walls around the frame 32 formed by the insulated liner 34 are relatively water-impervious so as to contain the volume V therein. In FIG. 2, no water has been added to the volume V, while in FIG. 3 water fills the volume V such that the subassembly of the frame 32 and liner 34 sinks down through the aperture 40.

The frame 32 possesses at least one, and preferably multiple lateral extensions 50 that engage the pontoon 30 and prevent complete passage of the frame 32 and liner 34 subcombination through the central aperture 40. In the illustrated embodiment, the lateral extensions 50 comprise rigid arms that project outward from the frame 32 at least partly across the radial dimension of the tubular pontoon 30. As seen in FIG. 3, the lateral extensions 50 rest on the top surface of the pontoon 30 and thus prevent the frame 32 and liner 34 subassembly from sinking through the central aperture 40. In a preferred embodiment, the operator fills the inner volume V of the hot tub 20 with water to a level that is just below the level of the external body of water W, such that when the users of the hot tub immerse themselves in the hot tub water, the inner and outer water levels are approximately the same. This creates an equilibrium such that the lateral extensions 50 rest lightly on the pontoon 30, and therefore reduces any deleterious effects of excess rubbing and the like. The lateral extensions 50 may also be shaped so as to reduce friction on the pontoon, and in the illustrated embodiment are bent down at their outer ends which helps to prevent injuries to someone entering or leaving the hot tub.

It should be understood that the illustrated lateral extensions 50 are merely one configuration for coupling the frame 32 and liner 34 subassembly with the pontoon 30. Another configuration is one or more flexible straps that extend from an upper periphery 52 of the frame 32 and attached to rings or other such anchors provided on the upper or outer surface of the pontoon 30. A still further alternative is to extend straps or a web of straps across the pontoon 30 and under the frame 32 and liner 34 subassembly, such as shown in phantom at 54 in FIG. 3. In the latter arrangement, the frame 32 and liner 34 subassembly are filled with water until they come to rest on the straps 54. In general, therefore, one or both of the frame/liner subassembly and pontoon 30 includes cooperating means for preventing passage of the subassembly entirely through the pontoon aperture. Those cooperating means could be rigid arms such as shown at 50 in FIG. 2, or flexible straps similarly connected to the frame 32. Alternatively, flexible straps could be provided on the liner 34. The cooperating means could also be mounted to the pontoon 30, such as the straps shown in phantom at 54 in FIG. 3. If straps connected to the frame 32 or liner 34 are used, they may couple to D-rings or cinches mounted to the pontoon 30, in which case the cooperating means are located on both components. Those of skill in the art will understand that there are numerous possible configurations of cooperating means, each of which functions to prevent passage of the subassembly of the frame 32 and liner 34, and thus sinking, entirely through the central aperture 40 of the pontoon 30.

Figure 4:
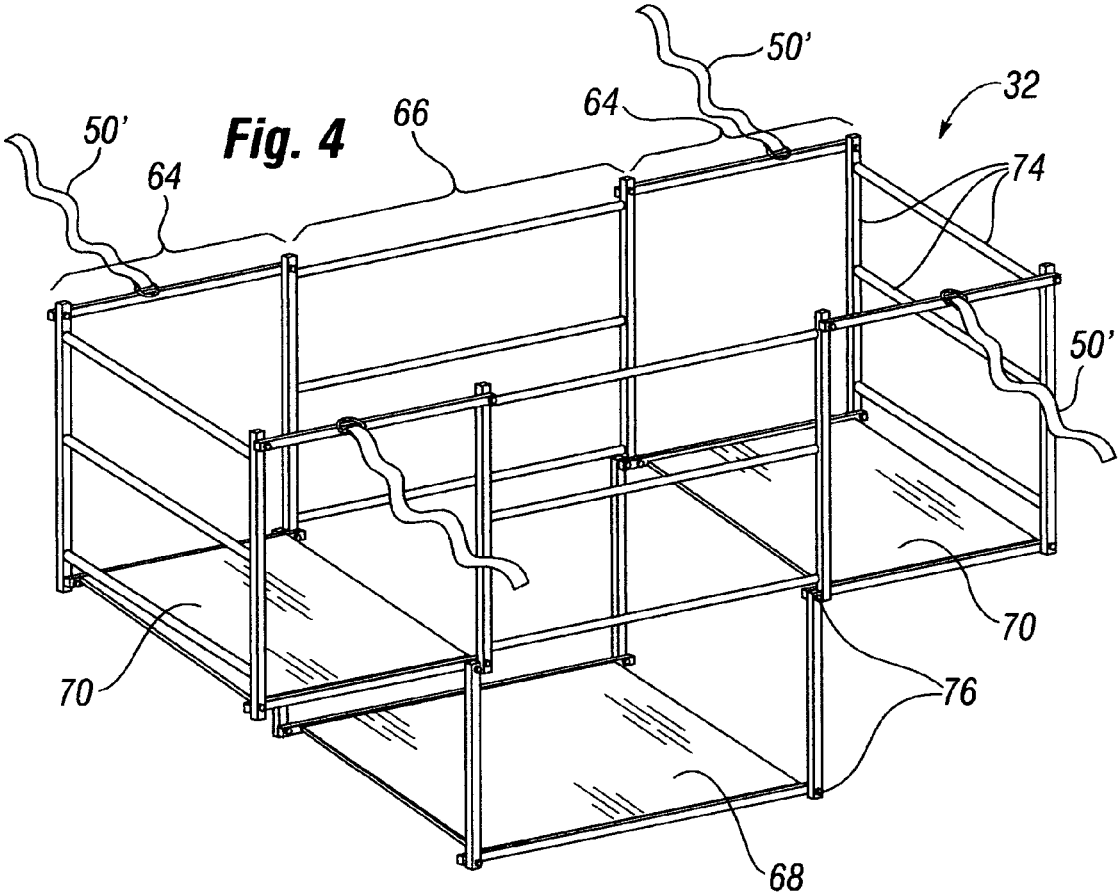
FIG. 4 is a perspective view of an exemplary rigid frame of the present invention in a deployed configuration.
Figure 5:
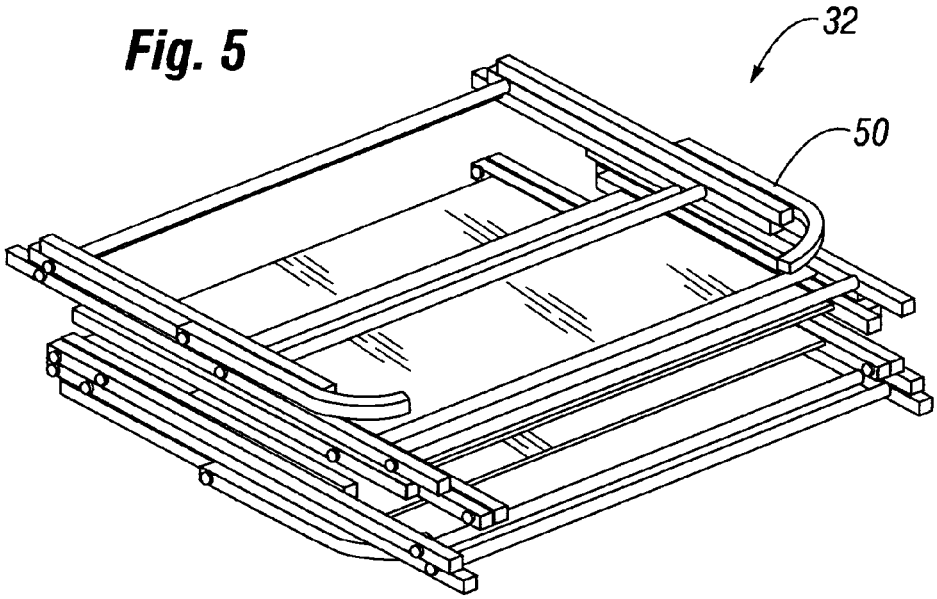
FIG. 5 is a perspective view of the rigid frame of FIG. 4 in a collapsed configuration.

FIGS. 4 and 5 illustrate an exemplary collapsible frame 32 for use in the hot tub 20 of the present invention. FIG. 4 shows the frame 32 in a deployed configuration, while FIG. 5 shows the frame in a collapsed configuration. In its deployed configuration, the frame 32 defines a substantially rectangular upper periphery 52 which, in a preferred embodiment, has a long dimension of about 5 feet and a short dimension of just under 3 feet. The frame 32 comprises a pair of end sections 64 separated by a middle section 66. The middle section 66 is approximately twice as deep as the end sections 64 and has a lower floor 68. Each of the end sections 64 includes a seat 70. The deployed frame 32 defines a volume therewithin suitable for two adults to sit facing each other on the seats 70 with their feet resting on the lower floor 68. Although not shown, a small removable step-ladder having hooks for resting on the upper periphery 52 of the frame 32 may be provided to make getting into the hot tub easier. FIG. 4 shows an alternative to the lateral extensions 50 in that flexible straps 50' may be used, while FIG. 5 shows the rigid extensions 50 as they would be folded in line with the struts of the frame 32.

In a preferred embodiment, the frame 32 comprises a series of members such as rods or struts 74 made of a rigid lightweight material such as aluminum or fiberglass and connected at junctions 76 that may be hinges or fasteners. Exemplary struts 74 include hollow pipes or rods of plastic, metal, or composites. Likewise, the lower floor 68 and seats 70 are constructed of lightweight panels of nylon or other flexible and strong material. As seen in FIG. 5, the frame desirably collapses upon itself to a relatively small profile; in the preferred embodiment, the size of the collapsed frame is approximately 28×28×10 inches in dimension, and weighs approximately 40 pounds. To facilitate rapid assembly and disassembly, some of the junctions 76 will be dedicated hinges (e.g., bolted or riveted), while some will be detachable. Some of the hinges may be freely rotating while others are lockable to fix the angle between two connected struts. In one embodiment, the two upper side panels in the middle section 66 completely detach from the rest of the frame 32 to facilitate collapse of the remainder of the frame about parallel hinge axes. Advantageously, no tools are required to set up or take down the frame 32. The struts 74 may be secured in their deployed orientations with large thumb screws at the hinged joints, and the resulting deployed frame 32 seen in FIG. 4 is firmly held in its desired form; that is, in a three-dimensional form defining a volume within which users of the hot tub sit.

Figures 6, 7, 8:
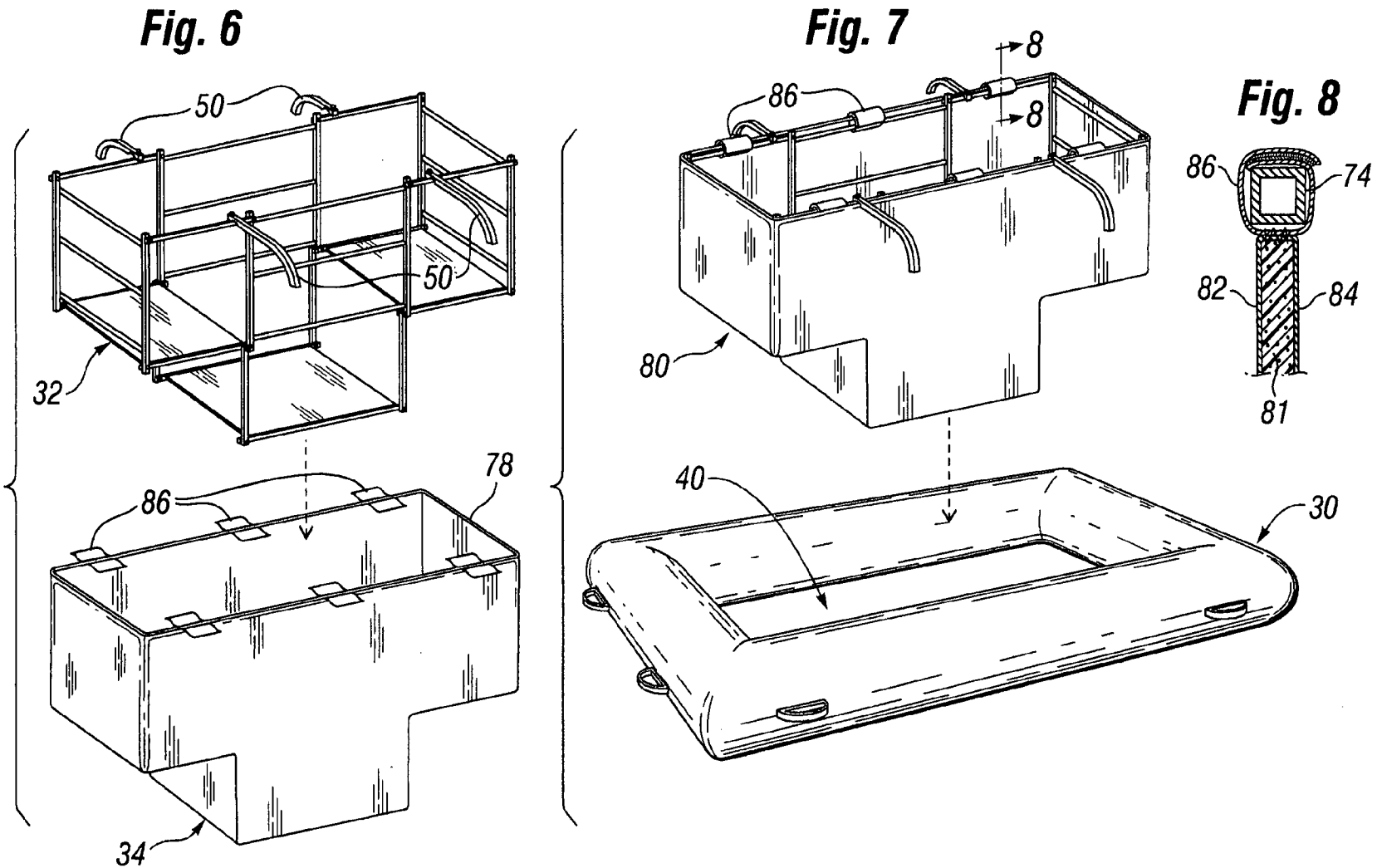
FIG. 6 is a perspective view of the deployed frame above an insulated liner representative of one step in an assembly process of the floating hot tub.
FIG. 7 is a perspective view of the assembled frame and insulated liner above an inflated pontoon representative of another step in the assembly process of the floating hot tub.
FIG. 8 is a sectional view through a portion of a wall of an exemplary insulated liner of the present invention.

FIGS. 6 and 7 schematically illustrate two of the steps in assembling the main components of the hot tub 20. FIG. 6 shows the deployed frame 32 above the insulated liner 34. The liner 34 is formed of the number of panels connected together so as to closely mirror the exterior shape of the deployed frame 32. Of course, the liner 34 is desirably formed of a flexible material such as NEOPRENE rubber, and only assumes the shape shown in FIG. 6 once draped around the deployed frame 32. An upper edge 78 of the liner 34 defines an opening through which the deployed frame passes. Because of the relative lack of form of the fabric-like liner 34, a preferred method of assembly is to invert the deployed frame 32 and pull the liner 34 down around it. In this respect, the lightweight nature of these two components facilitate their assembly in that one person can invert the frame 32, cover it with the liner 34, and invert the assembly 80. In an alternative arrangement, the insulated liner 34 is sized to fit closely within the deployed frame 32, rather than surrounding it. In either arrangement, the insulated liner 34 fits closely against the deployed frame 32, and may include a series of fasteners or hook and loop straps to secure the walls and floor of the liner against the frame, not just the upper periphery.

Subsequently, the frame 32 and liner 34 subassembly 80, seen in FIG. 7, inserts through the central aperture 40 of the pontoon 30. Desirably, the pontoon 30 has first been inflated and placed in the body of water in which the hot tub 20 will float.

FIG. 8 is a sectional view through a portion of the insulated liner 34. A number of materials having good insulating properties may be utilized, but preferably the liner 34 has an insulating core 81 made of a flexible, preferably foam, material such as NEOPRENE rubber. A protective internal barrier 82 and a protective external coating 84 sandwich the insulating core 81. The protective barrier 82 and coating 84 help prevent damage from sharp objects, and may be coated to help resist the growth of algae or barnacles. The insulated liner 34 may be made similar to standard wetsuit material, with an inner foam layer sandwiched by outer layers of polymer stretchy fabric. In one configuration, the hollow spaces in the foam liner are filled with nitrogen for its insulation value, as is typical in diving and exposure protection applications. This also makes the material quite buoyant, which supplements the buoyancy of the pontoon 30. Liners 34 for extremely cold water protection may be made of 7 mm thick NEOPRENE.

FIGS. 6 and 7 also illustrate an exemplary arrangement for coupling the frame 32 and liner 34. In particular, the liner 34 includes a plurality of pairs of tabs 86 spaced around and extending from its upper edge 78. Each pair of tabs 86 is sized to pass around one of the struts 74 of the frame 32 and couple to each other. The mating tabs may be coupled using hook and loop fasteners, snaps, or the like. In this regard, the process of assembling the liner 34 to the frame 32 is easy and quick, and can be reversed with the same speed.

With reference again to FIG. 1, the exemplary hot tub 20, once deployed, is filled with water from a source such as a hose, or from the surrounding body of water W utilizing a submergible pump 88. In this regard, submergible pump 88 can also be used to empty the hot tub 20 when it is time to disassemble the device.

As mentioned above, the portable heater 22 preferably includes a control and monitoring panel 90 and inlet and outlets 92 to which circulatory hoses 94 connect. In a preferred embodiment, the heater uses liquid propane (LP) gas, has a 12 V, 40 W power usage, and an output of 88,000 BTUs. The heater may be powered by a 12 V power source such as a cigarette outlet, or an optional 12 V battery. One particularly useful embodiment is to use a 36 V rechargeable wheelchair battery. An internal pump circulates water two and from the hot tub volume V through the hoses 94. The preferred heater 22 can heat 250 gallons of water from 60° F. to 105° F. in about one hour.

Figure 9:
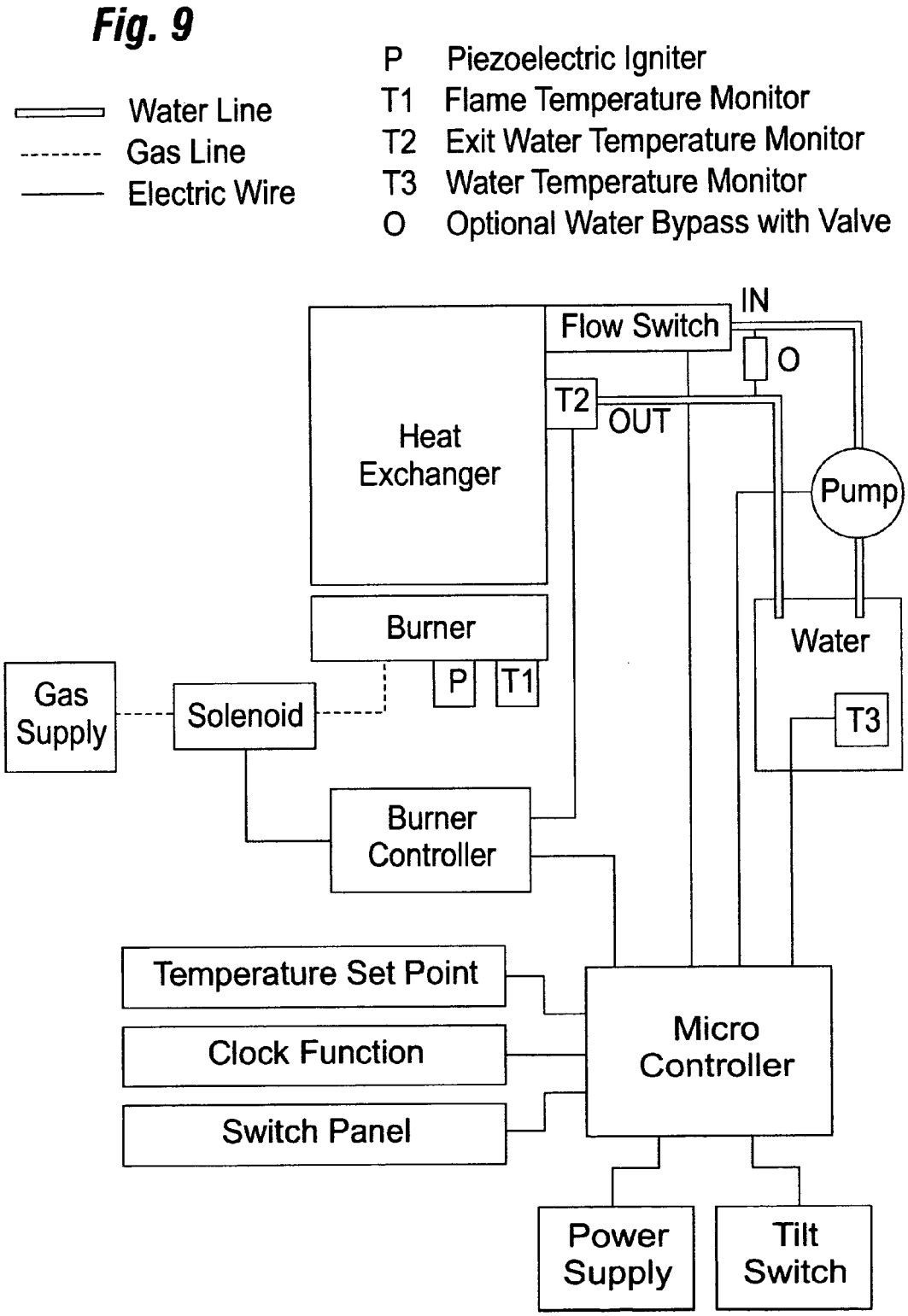
FIG. 9 is a schematic diagram of an exemplary portable heater used to rapidly heat water within the floating hot tub of the present invention.

FIG. 9 is a schematic diagram of preferred elements of the portable heater 22. Desirably, a portable gas heater is used that requires minimal electric power, is relatively small in size, and simple to install or couple to the portable hot tub 20. The water heater should include safety features such as a tilt shut-off switch, a flow switch, and a thermal shut-off switch. Desirably, the heat exchanger is a continuous-flow type made from thermally conductive material such as copper. Other materials may be used if the heater is used extensively in corrosive environments, such as in proximity to saltwater. The burner typically uses natural or LP gas and should have a heating capacity of 30,000 BTUs or greater.

In the embodiment illustrated in FIG. 9, a microcontroller receives input from the control panel 90 and various sensors, such as a flame temperature monitor, an exit water temperature monitor, and a hot tub water temperature monitor. Additionally, the portable heater 22 desirably includes a tilt switch connected to shut off the burner and pump if the housing of the heater tips a predetermined amount from upright. The tilt switch is extremely important for the present application, as the portable heater 22 may be placed in a boat where malfunction from tipping over and potential fire are extremely dangerous. The microcontroller is provided with a reset switch function that enables the heater 22 to be restarted shortly after being placed upright.

The microcontroller measures the temperature in the hot tub water with a thermocouple or thermistor, temperature T3. If the water temperature is too low, the microcontroller turns on the pump and ignites the burner. Once the desired temperature is reached, the microcontroller turns off the burner and then the pump. The microcontroller communicates to a burner controller which starts the burner. When switch on, the burner controller outputs a high-voltage pulse train to a piezo-igniter (P), opens the gas solenoid, and monitors a burner thermocouple output (T1). After the gas ignites, and the burner thermocouple is hot, the burner controller shuts off the piezo-igniter. If at any point the flame thermocouple (T1) or temperature out thermocouple (T2) is not hot, the gas solenoid shuts off immediately, thus turning of the gas burner. Optionally, the functions of the gas solenoid, thermocouple monitoring, etc., can be incorporated into the microcontroller.

The water pump associated with the portable heater 22 desirably uses minimal power, and may be submerged in water or not. Built pumps commonly used for boats can be used, but have very low power. Such pumps are capable of producing large flow rates with little water pressure.

The battery or power source used for driving the pump and the microcontroller may be integrated with the heater, which can be provided with an internal battery or a power lead for attaching to a 12 V outlet. Typically, the voltage of the pump within the heater is 12 V, and the current draw is less than 10 A.

The present invention enables extremely quick setup and takedown of the portable hot tub 20. First of all, the components of the hot tub 20, including everything shown in FIG. 1, can be collapsed and stored in one or more carry bags with a combined weight of less than 100 pounds. Desirably, the system components fit into one or more, and preferably two small luggage-sized bags that are easily transported and stored in a small space. In a preferred embodiment, the components of the system are collapsed and stored/transported in at least two bags to reduce the weight of each bag to less than 50 pounds. A frame bag that holds the pontoon 30, frame 32, and insulated liner 34, measures 28×28×10 inches, and weighs about 40 pounds full. A heater bag measures 24×24×9 inches, and weighs about 30 pounds full. The entire volume of the disassemble system is 9 $ft^3$ or less. The only other components are a small 12V blower, a bottle of LP gas, and an optional 12 V battery.

Setting the hot tub up occurs in the following steps:

a) Inflate the support pontoon 30—The pontoon may be adapted for manual inflation, but typically includes a valve that receives a nipple of a small 12V electric blower, commonly used with inflatable rafts, chairs, etc. The time required to deploy and inflate the pontoon 30 is under five minutes.

b) Construct the frame 32—Time required to deploy the frame 32 from its collapsed configuration is between 5-10 minutes, depending on the familiarity and dexterity of the person doing the work. Quick-connect joints such as spring-loaded pins greatly facilitate the process. Once finished, the frame 32 is inverted onto its upper periphery 52.

c) Place the insulating liner 34 over the frame—As mentioned above, the liner 34 closely surrounds the frame 32 and then the subassembly is turned right side up so as to join all of the pairs of tabs 86 around the upper periphery 52 of the frame.

d) Set the frame/insulating material in the support pontoon—This step can be seen in FIG. 3, and takes mere seconds because of the lightweight nature of the frame 32 and liner 34 subassembly 80.

e) Fill the tub with water—The time required to fill the inner volume V of the hot tub 20 depends on the capacity of the pump used, but typically a small submergible pump such as the one shown at 88 in FIG. 1 can fill the hot tub 20 in under 10 minutes. As the tub is filled with water the frame and liner subassembly 80 will sink into the body of water and through the central aperture 40 of the pontoon 30.

d) Heat the hot tub water—The preferred portable heater 22 described above can circulate water at 1-5, preferably 3, gallons per minute, and can heat 250 gallons from 60° F. to 105° F. in about 45 minutes.

The total setup operation from components being in the carry bags to the hot tub 20 floating and filled with hot water can be accomplished in less than two hours, and preferably in about one hour. That is, the setup time for the pontoon 30, frame 32 and liner 34 is between 10-20 minutes, and filling and heating the water takes between 50-70 minutes.

The process for taking down the hot tub 20 involves first pumping the water out from the internal volume V, which can be done with the submersible pump 88. As the water is pumped out, the frame and liner subassembly 80 will rise relative to the pontoon 30. Once the subassembly 80 has been substantially emptied, it can be separated from the pontoon 30 and inverted to completely empty it. Desirably, the liner 34 can be easily separated from the frame 32, such as by coupling the two elements with the hook and loop tabs 86. The user lifts the liner 34 off of the frame 32, inverts the frame, and collapses or otherwise folds both elements and stores them in carry bags. The pontoon 30 preferably has a port that can be opened wide for rapid deflation, and it is also folded and stored. The portable heater 22, submersible pump 88, and any other ancillary equipment are placed in their carry bag, which is typically separate from the frame, liner and pontoon. Providing two bags of 30-40 pounds in weight each is preferable than a single heavier bag. The entire disassembly process may take 20-30 minutes.

Although the preferred embodiment includes separate frame 32 and liner 34 elements that the user assembles at the time of deployment, the subassembly 80 shown in FIG. 7 may alternatively be provided as a single collapsible/expandable unit. The advantage of separate parts is that they can be collapsed into a smaller aggregate volume, facilitating transport and storage. On the other hand, a single unit can conceivably be designed for easier and faster deployment. Segments of the liner 34 may be pre-attached to corresponding frame struts 74 with straps, grommets, stitches, glue, etc.

It should be noted that hot water to fill the hot tub 20 can come from sources other than the portable gas-powered heater 22. For example, hot water from a boat motor or other hot water reservoir may be utilized. Alternatively, a solar heat exchange system which is relatively slower but more efficient may be used. Also, other portable heaters than the one described above, such as one that uses electric heating elements, can be substituted.

In the case of an "independent" hot water system, such as a solar heater, the heater may be supported on the pontoons that are used to float the hot tub. Alternatively the heating system may be placed on a small independent pontoon.

Moreover, in certain circumstances the portable floating hot tub 20 may be used to provide cooler water than the surrounding ambient body of water, such as in a mid-summer tropical environment. In that configuration, a water cooler rather than a heater is used.

The floating hot tub 20 described herein provides substantial structural integrity, as opposed to other commercial designs that are relatively flimsy. Because of the rigid internal frame 32, the overall shape of the hot tub 20 is maintained even in the presence of large external forces. The relatively large pontoon 30 helps to cushion the hot tub 20 in case of a collision with a boat or other objects, and the internal frame 32 prevents the shape from distorting. Moreover, the large pontoon 30 provides a relatively high barrier to keep cold water from entering the hot tub when there is turbulent or choppy water.

It is often enjoyable to float in the hot tub 20 a large distance from the boat or stock. In this case, a long line may be attached to the hot tub tether it to the boat or dock. Before floating away from the boat, the hoses 94 connecting the portable heater 22 from the internal volume V are removed. Alternatively, a separate pontoon for the heater unit 22 and an LP gas cylinder and battery pack can be floated next to the hot tub 20. More ambitiously, the hot tub 20 can be made autonomous from land or a boat by providing it with a small motor, such as a small electric outboard motor of 5 to 80 horsepower (4 to 60 kW), as shown in phantom in FIG. 1). Any means of propulsion may be supplied, including the aforementioned motor, oars, a double-ended paddle, even a small sail. Consistent with the principle that the hot tub 20 can be formed in a number of shapes, the exterior contours can be streamlined to resemble a small dinghy or Zodiac-style inflatable boat so as to facilitate trips around a harbor, for instance. The presence of the rigid frame 32 greatly enhances the ability for propulsion through the water as it supports the overall form of the hot tub. The relatively large pontoon 30, preferably about 1 foot in diameter, also helps make the hot tub 20 seaworthy, as it provides a relatively high barrier to waves splashing over the edge and into the internal volume V.

It is also conceivable that certain inventive principles of the hot tub 20 described herein may advantageously be incorporated into a somewhat less portable structure. For example, the highly portable collapsible rigid frame and insulated liner may be deployed and placed with a somewhat less portable pontoon structure, such as a Zodiac-style inflatable boat. In other words, a Zodiac-style or other small boat having a relatively large central aperture may remain in the water, such as in a harbor, but the other components of the portable hot tub 20 are stored on land and only deployed when needed. In this configuration, the construction of the pontoon can be significantly more robust, as well as providing a rugged mount for a larger motor, thus improving the ability to transit distances across open water. In this regard, therefore, the term "pontoon" encompasses both a simple bladder structure collapsible into a bag that can be hand-carried, as well as a more permanent structure such as defined above. With such as system, all the components but the pontoon remain extremely portable.

Furthermore, the insulated liner 34 provides excellent heat retention for the hot tub 20, even in water as cold as 32°. In a preferred embodiment, the insulated liner 34 has the capacity to lose only 1° F. of temperature of hot water (e.g., 105° F.) within the internal volume V every 20 minutes to surrounding water of 60° F. or less. The thickness of the insulating layer can be increased depending on the temperature of the surrounding environment, with a trade-off being a corresponding increase in weight and decreased portability. Also, a cover (not shown) over the top of the hot tub 20 may be provided to better retain heat when the hot tub is not in use.

One very useful option for the system shown in FIG. 1 is to provide a rod-like extension from the lower end of the portal heater 22 so that it can be mounted in a fishing rod holder off the back of the boat. Such an extension can be rigidly connected to the housing of heater 22, or a separate basket-like frame with the extension can be provided. In this way, the heater 22 is securely held in an upright position close to the hot tub 20.

Another useful option is to use a "heater" pontoon to hold the heater shown in FIG. 1 instead of a boat step or dock. The pontoon holds a battery, gas tank, and heater. Such an option allows attaching the tub and "heater" pontoon to a mooring and leaving the unit to go out boating. When returning from boating the water in the tub would be hot.

Although the invention has been described and illustrated with a certain degree of particularity, it is understood that the present disclosure has been made only by way of example, and that numerous changes in the combination and arrangement of parts can be resorted to by those skilled in the art without departing from the scope of the invention, as hereinafter claimed.

What is claimed is:

1. A portable floating hot tub, comprising:

a collapsible frame of connected rigid members having a collapsed configuration and a deployed configuration, wherein the deployed frame forms an interior volume, at least one seat for a person within the volume, and an upper periphery;

an insulated liner sized and shaped to fit closely against and attach to the deployed frame to form a subassembly and define a hot tub fill volume within the liner;

an inflatable pontoon arranged to buoyantly support the deployed frame and liner subassembly;

cooperating means provided on the collapsible frame, the insulated liner, and/or the inflatable pontoon for coupling the frame and liner subassembly to the pontoon, the inflated pontoon having sufficient buoyancy to support the frame and liner subassembly in a body of water with the upper periphery of the frame above the water level; and a source of hot water connected to circulate water to and from the hot tub fill volume.

2. The floating hot tub of claim 1, wherein the cooperating means comprises at least one lateral extension from the frame and liner subassembly that engages the pontoon.

3. The floating hot tub of claim 1, wherein the cooperating means comprises flexible straps.

4. The floating hot tub of claim 1, wherein the source of hot water comprises a hand-carried portable heater having an inlet and an outlet and hoses connected therewith for circulating water to and from the hot tub fill volume.

5. The floating hot tub of claim 1, wherein the insulated liner comprises a foam core and protective outer layers.

6. The floating hot tub of claim 1, wherein the insulated liner is easily separable from the frame.

7. The floating hot tub of claim 1, wherein the collapsible frame comprises a plurality of lightweight rigid struts connected at junctions.

8. The floating hot tub of claim 1, further including a small motor mounted on the pontoon for autonomous navigation of the hot tub.

9. The floating hot tub of claim 1, wherein the inflatable pontoon has a closed geometric form surrounding a central aperture within which the deployed frame and liner subassembly are peripherally supported.

10. A portable floating hot tub, comprising:

a collapsible frame of connected rigid members having a collapsed configuration and a deployed configuration, wherein the deployed frame forms an interior volume, at least one seat for a person within the volume, and an upper periphery;

an insulated liner sized and shaped to fit closely against and attach to the deployed frame to form a subassembly and define a hot tub fill volume within the liner;

a pontoon arranged to buoyantly support the deployed frame and liner subassembly, the pontoon having sufficient buoyancy to support the frame and liner in a body of water with the upper periphery of the frame above the water level; and a hand-carried portable heater having an inlet and an outlet and hoses connected therewith for circulating water to and from the hot tub fill volume, the heater having a tilt sensor that shuts off operation of the heater if the heater tilts more than a predetermined amount from an upright orientation.

11. The floating hot tub of claim 10, further including cooperating means provided on the collapsible frame, the insulated liner, and/or the pontoon for buoyantly coupling the frame and liner subassembly to the pontoon.

12. The floating hot tub of claim 10, wherein the collapsible frame comprises a plurality of rigid struts hinged together.

13. The floating have tub of claim 10, wherein the heater includes a gas burner and an electric control therefore, and has a heating capacity of at least 30,000 BTUs.

14. The floating hot tub of claim 10, further including a submergible water pump having an inlet and an outlet with an outlet hose connected to the inlet of the heater.

15. The floating hot tub of claim 10, wherein a pontoon is provided for supporting the heater, battery, and gas source.

16. A portable floating hot tub, comprising:

a collapsible frame of connected rigid members having a collapsed configuration and a deployed configuration, wherein the deployed frame forms an interior volume, at least one seat for a person within the volume, and an upper periphery;

an insulated liner sized and shaped to fit closely against and attach to the deployed frame to form a subassembly and define a hot tub fill volume within the liner;

an inflatable pontoon arranged to buoyantly support the deployed frame and liner subassembly; and a hand-carried portable heater for circulating water to and from the hot tub fill volume;

wherein the above components can be collapsed and stored in one or more carry bags with a combined weight of less than 100 pounds.

17. The floating hot tub of claim 16, wherein the collapsible frame comprises a plurality of lightweight rigid struts connected at junctions, some of which are dedicated hinges and some of which are detachable.

18. The floating hot tub of claim 16, wherein the inflatable pontoon has a closed geometric form surrounding a central aperture within which the deployed frame and liner subassembly are peripherally supported.

19. The floating hot tub of claim 16, wherein the insulated liner is easily separable from the frame.

20. The floating hot tub of claim 19, wherein the insulated liner has a plurality of tabs secured thereto for attaching the liner to the deployed frame.

* * * * *